US009221165B2

(12) United States Patent
Wiedner et al.

(10) Patent No.: US 9,221,165 B2
(45) Date of Patent: Dec. 29, 2015

(54) TOOL RECEPTACLE

(75) Inventors: Aaron Wiedner, Landsberg (DE); Markus Hartmann, Mauerstetten (DE); Udo Hauptmann, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 713 days.

(21) Appl. No.: 13/492,371

(22) Filed: Jun. 8, 2012

(65) Prior Publication Data

US 2012/0313333 A1 Dec. 13, 2012

(30) Foreign Application Priority Data

Jun. 9, 2011 (DE) ..... 10 2011 077 244

(51) Int. Cl.
*B23B 31/107* (2006.01)
*B25D 17/08* (2006.01)

(52) U.S. Cl.
CPC ..... *B25D 17/088* (2013.01); *B25D 2217/0042* (2013.01); *B25D 2250/371* (2013.01); *Y10S 279/905* (2013.01); *Y10T 279/17076* (2015.01); *Y10T 279/17145* (2015.01); *Y10T 279/17761* (2015.01)

(58) Field of Classification Search
CPC ..... B25D 17/088; B25D 2217/0042; B25D 2250/371; Y10S 279/905; Y10T 279/17076; Y10T 279/17145
USPC ..... 279/19.4, 22, 905, 19.5, 19.6
See application file for complete search history.

(56) References Cited

U.S. PATENT DOCUMENTS

| | | | | |
|---|---|---|---|---|
| 5,601,388 | A * | 2/1997 | Lauterwald | 408/239 R |
| 6,073,705 | A * | 6/2000 | Shibata et al. | 173/200 |
| 6,179,300 | B1 * | 1/2001 | Baumann et al. | 279/19.4 |
| 7,338,051 | B2 * | 3/2008 | Buchholz | 279/19 |
| 2003/0089509 | A1 * | 5/2003 | Wanek et al. | 173/48 |
| 2008/0197583 | A1 * | 8/2008 | Furusawa et al. | 279/30 |
| 2011/0101629 | A1 * | 5/2011 | Wienhold | 279/79 |

FOREIGN PATENT DOCUMENTS

| | | | |
|---|---|---|---|
| DE | 93 05 463 | U1 | 8/1993 |
| DE | 196 36 293 | A1 | 3/1997 |
| DE | 100 02 749 | A1 | 8/2001 |
| EP | 0 668 127 | A1 | 8/1995 |
| EP | 1 790 424 | A1 | 5/2007 |

OTHER PUBLICATIONS

European Search Report, dated Aug. 31, 2012, 5 pages.

* cited by examiner

*Primary Examiner* — Eric A Gates
*Assistant Examiner* — Chwen-Wei Su
(74) *Attorney, Agent, or Firm* — Crowell & Moring LLP

(57) ABSTRACT

A tool receptacle is disclosed. The tool receptacle has a spindle which has a receiving area for receiving a tool and an elongated hole which is open into the receiving area in a radial direction. A barrier element disposed in the elongated hole projects into the receiving area and is movable in the elongated hole. A slider is used for sliding the barrier element to an output-side end of the elongated hole, where the slider is subject to the application of force by a first spring against an insertion direction. A radial limit stop forces the barrier element in the radial direction to engage in the receiving area. The radial limit stop is displaceable to enable a radial movement of the barrier element out of engagement with the receiving area. A second spring applies a spring force to the radial limit stop against the insertion direction.

6 Claims, 2 Drawing Sheets

TOOL RECEPTACLE

This application claims the priority of German Patent Document No. DE 10 2011 077 244.8, filed Jun. 9, 2011, the disclosure of which is expressly incorporated by reference herein.

BACKGROUND AND SUMMARY OF THE INVENTION

The present invention relates to a tool receptacle, in particular for a chiseling, purely chiseling and/or bore-cutting power tool. The tool receptacle is designed in particular for chiseling and lathing tools, which have an elongated locking groove on the shaft end.

The tool receptacle according to the invention has a spindle, which has a cylindrical or prismatic receiving area that is open on the output side and oriented along a working axis for receiving a tool in the insertion direction and an elongated hole sticking into the receiving area in the radial direction. The spindle may be detachably or non-detachably connected to a drive of a handheld power tool, e.g., a hammer drill. A barrier element, e.g., a sphere, located in the elongated hole projects into the receiving area and is movable between an output-side end of the elongated hole and a drive-side end of the elongated hole. The number of elongated holes and barrier elements is not restricted to exactly one; several elongated holes may also be provided in which exactly one barrier element respectively is disposed. A slider is used to slide the barrier element to the output-side end of the elongated hole, wherein the slider overlaps with the barrier element in the radial direction and is subject to the application of force by a first spring against the insertion direction. A radial limit stop forces the barrier element adjacent to it in the radial direction to engage in the receiving area. The radial limit stop overlaps in a locked position with the output-side end of the elongated hole, thereby preventing the barrier element located in the output-side end from a radial movement, and the radial limit stop is displaceable against the insertion direction against the spring force of the first spring to enable a radial movement of the barrier element out of engagement with the receiving area. A second spring is supported on the slider in the insertion direction and applies a spring force to the radial limit stop against the insertion direction.

In the initial position, the barrier element is held by the slider on the output-side end of the elongated hole. The radial limit stop overlaps with the barrier element in the initial position in the axial direction, thereby keeping the barrier element engaged in the receiving area in the initial position. The initial position corresponds to a locked position of the tool receptacle. An operator may displace the radial limit stop against the first spring to the drive-side end, whereupon the barrier element is able to come completely out of the receiving area in the radial direction. A tool located in the tool receptacle is hereby released. The second spring facilitates the insertion of the tool when the tool receptacle is held vertically. The second spring keeps the radial limit stop overlapping with the output-side end of the elongated hole without the actuation of the operator. In the case of insertion with the tool, the operator displaces the barrier element including the slider in the direction towards the drive-side end. On the drive-side end, the barrier element is able to yield radially unimpeded because of the radial limit stop and free the receiving area. The two springs may be disposed on opposite sides of the slider.

The following description explains the invention on the basis of exemplary embodiments and figures.

DETAILED DESCRIPTION OF THE DRAWINGS

Unless otherwise indicated, the same or functionally equivalent elements are identified by the same reference numbers in the figures. Unless explicitly indicated otherwise, radial and axial directions relate to a working axis of the power tool. Without further qualification, orientations are indicated with respect to an impact direction of the power tool, according to which a rear element is offset from a front element in the impact direction. A length designates a dimension of a (longitudinal) direction of the greatest extension of a body and a width is the greatest dimension in the plane perpendicular to the longitudinal direction.

Figure 1:
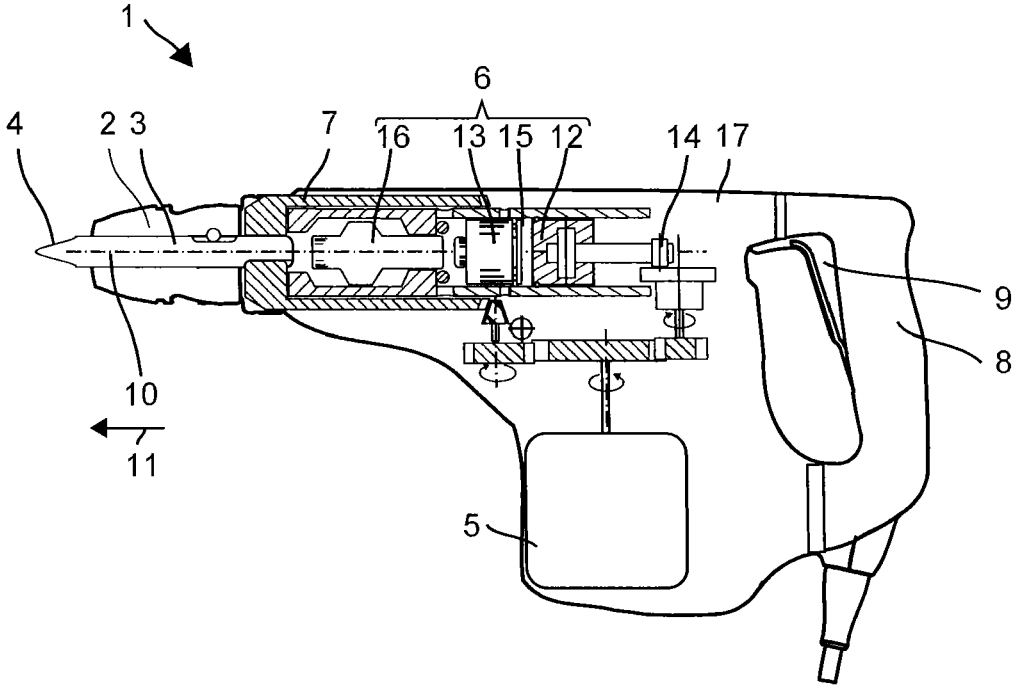
FIG. 1 illustrates a handheld power tool.

FIG. 1 schematically shows a hammer drill 1 as an example of a chiseling handheld power tool. The hammer drill 1 has a tool receptacle 2, in which a shaft end 3 of a tool, e.g., of a boring tool 4, may be inserted. A primary drive of the hammer drill 1 forms a motor 5, which drives a striking mechanism 6 and an output shaft 7. An operator may guide the hammer drill 1 by a hand grip 8 and put the hammer drill 1 into operation by a system switch 9. During operation, the hammer drill 1 rotates the boring tool 4 continuously around a working axis 10 and in doing so is able to drive the boring tool 4 into a substrate in the impact direction 11 along the working axis 10.

The striking mechanism 6 is a pneumatic striking mechanism 6 for example. An exciter 12 and a striking device 13 are movably guided in the striking mechanism 6 along the working axis 10. The exciter 12 is coupled to the motor 5 via an eccentric 14 or a wobble finger and forced into a periodic, linear movement. A pneumatic spring formed by a pneumatic chamber 15 between the exciter 12 and striking device 13 couples a movement of the striking device 13 to the movement of the exciter 12. The striking device 13 may directly strike a rear end of the boring tool 4 or transmit a portion of its momentum to the boring tool 4 indirectly via an essentially resting intermediate striking device 16. The striking mechanism 6 and preferably the other drive components are disposed inside a machine housing 17.

Figure 2:
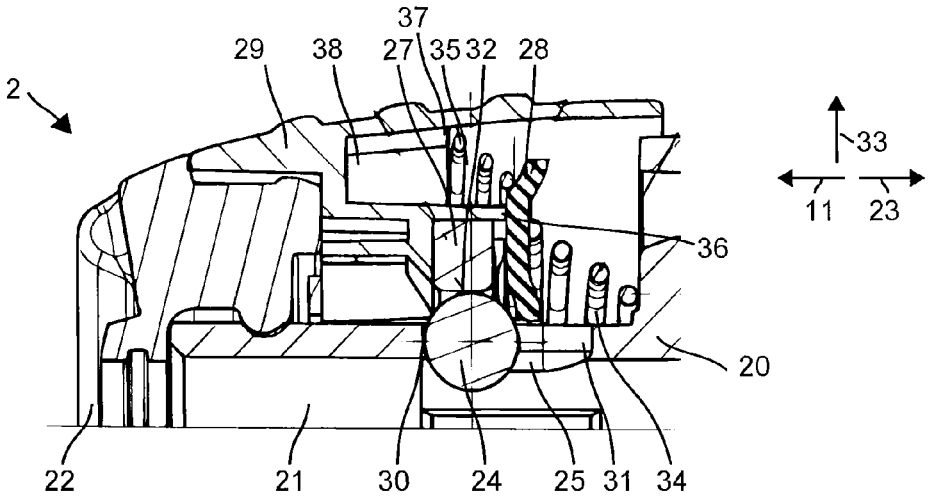
FIG. 2 illustrates a first embodiment of a tool receptacle in accordance with the principles of the present invention.

FIG. 2 shows an exemplary embodiment of the tool receptacle 2. The tool receptacle 2 has a hollow spindle 20 driven by the output shaft 7 with a receiving area 21 for the tool 4. The tool 4 may be inserted into the receiving area 21 through an output-side opening 22 in the insertion direction 23 (opposite from the impact direction 11). The receiving area 21 is preferably designed to be complementary to the shaft end 3, e.g., cylindrical.

The tool 4 provided with locking grooves is locked in a detachable manner in the receiving area 21 by barrier elements, in this case with spheres 24 for example. The spheres 24 are inserted in elongated holes 25 in a wall of the hollow spindle 20. A radial restraint of the spheres 24 is accomplished with a locking ring 27, at which the spheres 24 partially project into the receiving area 21 from the radial inside. The portion of the spheres 24 projecting into the receiving area 21 is able to engage in the locking groove of the tool 4. A spring-loaded slider 28 keeps the spheres 24 inside the locking ring 27, i.e., overlapping axially with the locking ring 27.

When inserting the tool, the spheres 24 are displaced against the spring-loaded slider 28 and come out of engagement with the locking ring 27. The spheres 24 are able to yield radially and free the receiving area 21. The locking ring 27 is able to be displaced against the spring-loaded slider 28 by an actuating sleeve 29, thereby canceling the radial restraint of the spheres 24 and allowing an inserted tool to be removed.

The exemplary spindle 20 has two opposing elongated holes 25 in its jacket-like wall. The elongated holes 25 are aligned parallel to the working axis 10. A distance of an output-side end 30 from a drive-side end 31 is preferably larger than a width of the elongated holes 25. One of the spheres 24 is inserted into each of the elongated holes 25. A diameter of the spheres 24 is greater than a wall thickness of the spindle 20, whereby the spheres 24 partially project into the receiving area 21 and partially extend beyond the spindle 20. Instead of spheres, rollers, rolls, etc., may also be used as the barrier element.

The locking ring 27 has a radially inwardly pointing limit stop surface 32. The limit stop surface 32 is preferably cylindrical. A radial distance of the limit stop surface from the working axis 10 is dimensioned in such a way that the spheres 24 project into the receiving area 21 while touching the limit stop surface 32. An axial dimension of the limit stop surface 32 is smaller than a length of the elongated holes 25 measured from the output-side end 30 to the drive-side end 31. The limit stop surface 32 and the output-side end 30 of the elongated hole 25 overlap along the working axis 10 in a locked position of the locking ring 27, which at the same time is the initial position. In the initial position there is no axial overlap of the limit stop surface 32 with the drive-side end 31 of the elongated hole 25. For an unlocked position, the locking ring 27 is displaced axially from the output-side end 30 at least enough that the spheres 24 are able to completely exit from the receiving area 21 while yielding radially.

The exemplary locking ring 27 is connected to the actuating sleeve 29 integrally and/or in a form-fitting manner. The actuating sleeve 29 has a freely accessible outer surface, which the operator is able to grip. The actuating sleeve 29 including the locking ring 27 is displaceable by an operator out of an initial position into the unlocked position.

The slider 28 is disposed on the drive side of the spheres 24. The exemplary slider 28 is an annular disk, which is slid on the spindle 20. The slider 28 is axially movable longitudinally along the working axis 10 against the spindle 20, the spheres 24 and the locking ring 27. The spheres 24 and the slider 28 overlap in the radial direction 33, whereby the slider 28 may be adjacent to the spheres 24 on the drive side.

A first spring 34 acts on the slider 28 in the impact direction 11. The slider 28 loaded by the first spring 34 keeps the spheres 24 on or near the output-side end 30 of the elongated hole 25, thereby engaging the spheres 24 with the radial limit stop surface 32. The locking ring 27 or the actuating sleeve 29 form an output-side limit stop for the slider 28, whereby the first spring 34 is also able to act indirectly on the locking ring 27. The actuating sleeve 29 counteracts the first spring 34 when being displaced from the initial position to the unlocked position.

A second spring 35 is disposed in a pre-tensioned manner between the actuating sleeve 29 and the slider 28. The second spring 35 touches the slider 28, which is axially movable against the locking ring 27. During insertion of the tool 4, the tool 4 slides the spheres 24 and indirectly the slider 28 to the drive-side end 31 of the elongated hole 25. In the process, the slider 28 disengages from the locking ring 27 or the actuating sleeve 29. The second spring 35 acts on the locking ring 27 in the impact direction 11 and thereby keeps the locking ring 27 in its initial position near the output-side end 30 of the elongated hole 25.

The actuating sleeve 29 has an axial first drive-side contact surface 36, on which the slider 28 rests in the initial position. A second drive-side contact surface 37 is provided along the working axis 10 in the impact direction 11 offset from the first contact surface 36. The second spring 35 is applied to this second contact surface 37.

The two springs 34, 35 may be designed to be helical springs for example. The first spring 34 exerts a greater force on the slider 28 than the second spring 35.

Figure 3:
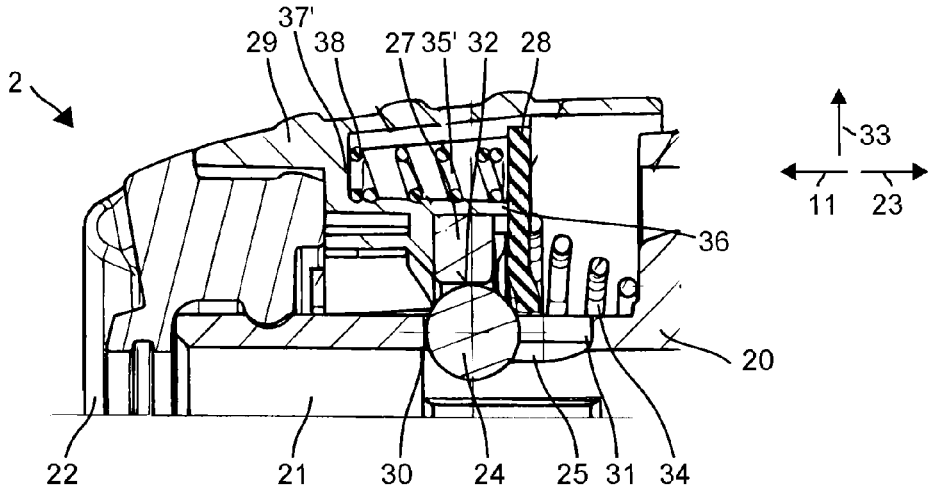
FIG. 3 illustrates a second embodiment of a tool receptacle in accordance with the principles of the present invention.

FIG. 3 shows a variation of the tool receptacle 2 in which the second spring 35' and the second contact surface 37' are different. The actuating sleeve 29 has a pocket 38, whose axial end forms the second contact surface 37' and is disposed in the second spring 35'.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A tool receptacle, comprising:

a spindle, wherein the spindle defines a receiving area which is open on an output end and is oriented along a working axis for receiving a tool in an insertion direction and wherein the spindle defines an elongated hole which is open into the receiving area in a radial direction;

a barrier element disposed in the elongated hole, wherein the barrier element is protrudable into the receiving area and is movable between an output-side end of the elongated hole and a drive-side end of the elongated hole;

a slider, wherein the barrier element is slidable by the slider to the output-side end of the elongated hole and wherein the slider overlaps with the barrier element in a radial direction;

a first spring, wherein a force applyable by the first spring acts on the slider in an impact direction;

a radial limit stop, wherein the barrier element is engageable with the radial limit stop in the radial direction, and wherein the radial limit stop, in a locked position, overlaps with the output-side end of the elongated hole; and a second spring, wherein a force applyable by the second spring acts on the radial limit stop in the impact direction;

wherein the first spring is disposed on a drive side of the slider and the second spring is disposed on an output side of the slider and wherein the second spring engages the slider.

2. The tool receptacle according to claim 1, further comprising an actuating sleeve, wherein the actuating sleeve is connected to the radial limit stop.

3. The tool receptacle according to claim 1, wherein the force applyable by the first spring on the slider is greater than a force applyable by the second spring on the slider.

4. The tool receptacle according to claim 1, wherein the second spring is pre-tensioned.

5. The tool receptacle according to claim 1, further comprising an actuating sleeve, wherein the actuating sleeve is connected to the radial limit stop and wherein the second spring is adjacent to the actuating sleeve on the output side.

6. A tool receptacle, comprising:

a spindle, wherein the spindle defines a receiving area which is open on an output end and is oriented along a working axis for receiving a tool in an insertion direction and wherein the spindle defines an elongated hole which is open into the receiving area in a radial direction;

a barrier element disposed in the elongated hole, wherein the barrier element is protrudable into the receiving area and is movable between an output-side end of the elongated hole and a drive-side end of the elongated hole;

a slider, wherein the slider is engageable with the barrier element;

a locking ring, wherein the locking ring is engageable with the barrier element;

a first spring disposed on a drive side of the slider and engageable with the slider; and a second spring disposed on an output side of the slider and engageable with the locking ring and the slider.

* * * * *